US005887649A

United States Patent [19]

Kim

[11] Patent Number: 5,887,649

[45] Date of Patent: Mar. 30, 1999

[54] HEAT EXCHANGER FINS OF AN AIR CONDITIONER

[75] Inventor: Young-Saeng Kim, Incheon, Rep. of Korea

[73] Assignee: Samsung Electronics Co., Ltd, Suwon, Rep. of Korea

[21] Appl. No.: 991,573

[22] Filed: Dec. 16, 1997

[30] Foreign Application Priority Data

Dec. 30, 1996 [KR] Rep. of Korea ..... 1996 77585

[51] Int. Cl.[6] ..... F28D 1/04

[52] U.S. Cl. ..... 165/151; 165/146; 165/181

[58] Field of Search ..... 165/146, 151, 165/181

[56] References Cited

U.S. PATENT DOCUMENTS

| | | | |
|---|---|---|---|
| 4,469,167 | 9/1984 | Itoh et al. | 165/151 |
| 4,756,362 | 7/1988 | Kudoh et al. | 165/151 |
| 5,062,475 | 11/1991 | Bemisderfer et al. | 165/151 |
| 5,099,914 | 3/1992 | Reifel | 165/151 |
| 5,353,866 | 10/1994 | Ueda et al. | 165/151 |
| 5,685,367 | 11/1997 | Jun | 165/151 |
| 5,706,885 | 1/1998 | Kim | 165/151 |

*Primary Examiner*—Leonard R. Leo
*Attorney, Agent, or Firm*—Burns, Doane, Swecker & Mathis, L.L.P.

[57] ABSTRACT

A heat exchanger includes parallel fins and heat transfer pipes extending through the fins for conducting a heat transfer fluid. Each fin includes four groups of slit-forming grilles disposed between each vertically spaced pair of pipes. The first and third groups are disposed below a first pipe of the pair, and the second and fourth groups are disposed above a second pipe of the pair. The third group is disposed behind the first group, and the fourth group is disposed behind the second group, considered with reference to a direction of fluid flow. An intermediate slit-forming grille is located behind the first and second groups and in front of the third and fourth groups. The grilles of each of the first and second groups project from the fin by respective heights which become progressively greater in the direction of fluid flow. The grilles of each of the third and fourth groups project from the fin by respective heights which become progressively greater, or alternatively shorter, in the direction of fluid flow.

14 Claims, 5 Drawing Sheets

HEAT EXCHANGER FINS OF AN AIR CONDITIONER

BACKGROUND OF THE INVENTION

1. Field of the Invention

The present invention relates to a heat exchanger of an air conditioner, and more particularly to a heat exchanger of an air conditioner in which grille type grilles are formed in a flat fin.

2. Description of the Prior Art

A heat exchanger of an air conditioner according to the prior art includes, as illustrated in FIG. 1, a plurality of flat fins 1 provided in parallel at a predetermined spacing, and heat transfer pipes 2 arranged perpendicular to the fins 1 and provided in zigzag style. The air current moves between the fins 1 in a direction represented by an arrow to perform a heat exchange with fluid in the heat transfer pipes 2.

Furthermore, as regards heat fluid characteristics around the fins, a temperature boundary layer 3 on a heat transfer surface of the fins 1 becomes, as depicted in FIG. 2, thicker in proportion to the square root of a distance from an entry end of the air current. Thus, there is a disadvantage in that a heat transfer rate between the air current and fins is remarkably decreased as the distance from the entry end of the air current increases, and thereby decreases the heat transfer efficiency of the heat exchanger.

There is still another disadvantage when air current of low speed moves past the heat transfer pipes 2, in that a cavitation zone 4 is generated at a rear area of each heat transfer pipe 2 (i.e., the area cross hatched in FIG. 3), so that a heat transfer rate is remarkably decreased at the cavitation zone 4 to thereby cause a drop in heat transfer performance of the heat exchanger.

As a prior art to deal with the aforementioned disadvantages, Japanese Laid/Open Utility Model Application No. Sho. 55-110995 is disclosed, where the fins of an air conditioner are, as illustrated in FIG. 4, formed with groups of slit-forming grilles 5*a*, 5*b*, 5*c*, 5*d*, 5*e* and 5*f* disposed in a vertical gap formed between the heat transfer pipes 2.

In other words, the grilles 5*a*, 5*c* and 5*e* as illustrated in FIG. 5, are caused to protrude from one surface of the fin 1 by a cutting and bending process, with the grilles arranged at a predetermined interval, and the other grilles 5*b*, 5*d* and 5*f* protrude from the opposite surface of the fin 1 and are arranged between the grilles 5*a*, 5*c* and 5*e*.

The fins 1 formed with the groups of grilles 5*a*, 5*b*, 5*c*, 5*d*, 5*e* and 5*f* can expect a high heat transfer performance compared with fins having no grilles. The upstream grilles 5*a* and 5*b* provide a high heat transfer performance because a thin temperature boundary layer is formed thereby. However, the heat transfer performance becomes lower at the downstream grilles 5*c*, 5*d*, 5*e* and 5*f* because those grilles 5*c*, 5*d*, 5*e* and 5*f* are disposed in the temperature boundary layer formed by the grilles 5*a* and 5*b*.

There is another problem in that a cavitation zone where the air current does not flow is generated at a rear side of the heat transfer pipe 2, thereby reducing heat transfer efficiency.

There is still another problem in that the fin has a limited heat transfer area and is relatively easily bendable.

SUMMARY OF THE INVENTION

The present invention relates to a heat exchanger adapted for use in an air conditioner. The heat exchanger includes a plurality of parallel fins spaced apart to conduct an air flow between each pair of adjacent fins. Heat transfer pipes extend through the fins perpendicular thereto for conducting a heat transfer fluid. The fins comprise first, second, third, and fourth groups of slit-forming grilles disposed between each vertically spaced pair of pipes. The first and third groups are disposed below a first of the pipes of the pair, and the second and fourth groups are disposed above a second pipe of the pair. The third group is disposed behind the first group with reference to a direction of fluid flow, and the fourth group is disposed behind the second group. An intermediate slit-forming grille is located behind the first and second groups and in front of the third and fourth groups. Each of the grilles extends transversely relative to the fluid flow direction. The grilles of each of the first and second groups project from the fin by respective heights which become progressively greater in the direction of fluid flow. The grilles of each of the third and fourth groups project from the fin by respective heights which become progressively greater in the direction of fluid flow.

Alternatively, the grilles of the third and fourth groups could project from the fin by heights which become progressively shorter in the direction of fluid flow.

Preferably, each of the groups includes some grilles extending from a first side of the fin and some grilles extending from a second side of the fin in alternating relationship to the grilles of the first side with reference to the fluid flow direction.

Preferably, each grille is spaced from adjacent grilles by a solid portion of the fin.

The grilles of the first and third groups preferably extend generally radially with respect to the first pipe, and the grilles of the second and fourth groups extend generally radially with respect to the second pipe.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE PREFERRED EMBODIMENTS OF THE INVENTION

Figure 1:
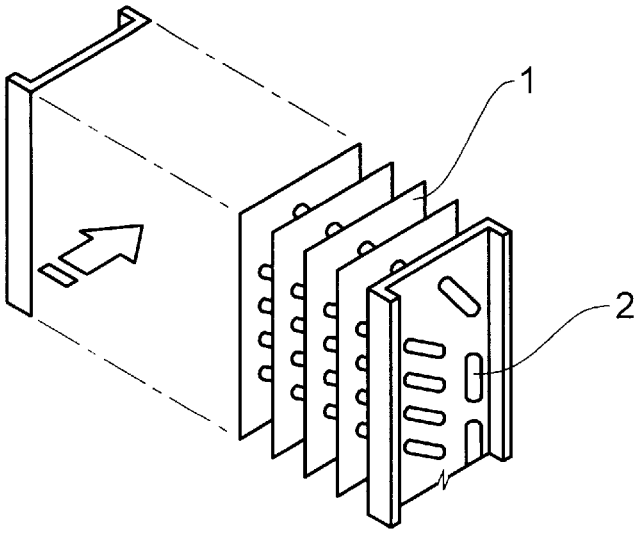
FIG. 1 (PRIOR ART)
FIG. 1 is a perspective view of a heat exchanger according to the prior art.
Figure 2:
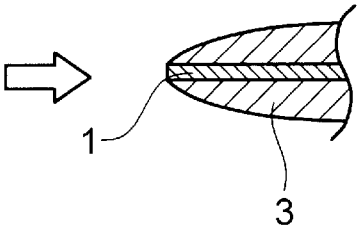
FIG. 2 (PRIOR ART)
FIG. 2 is an enlarged view for illustrating a thermal fluid characteristic around a flat fin in FIG. 1.
Figure 3:
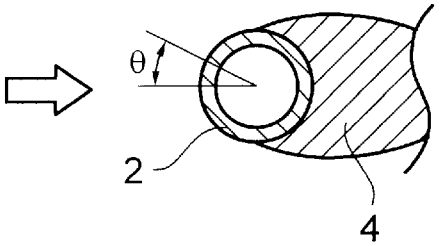
FIG. 3 (PRIOR ART)
FIG. 3 is an enlarged view for illustrating a thermal fluid characteristic around a heat transfer pipe in FIG. 1.
Figure 4:
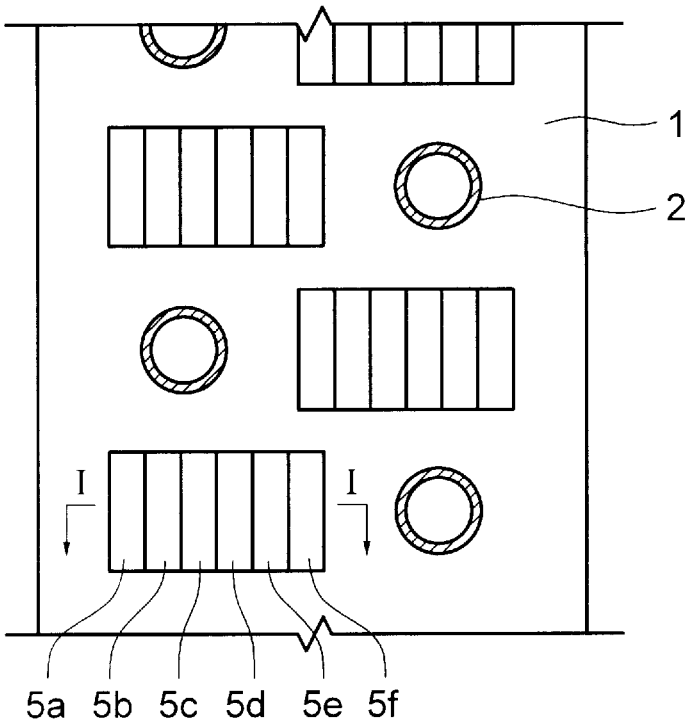
FIG. 4 (PRIOR ART)
FIG. 4 is a plan view of a flat fin of another heat exchanger according to the prior art.
Figure 5:
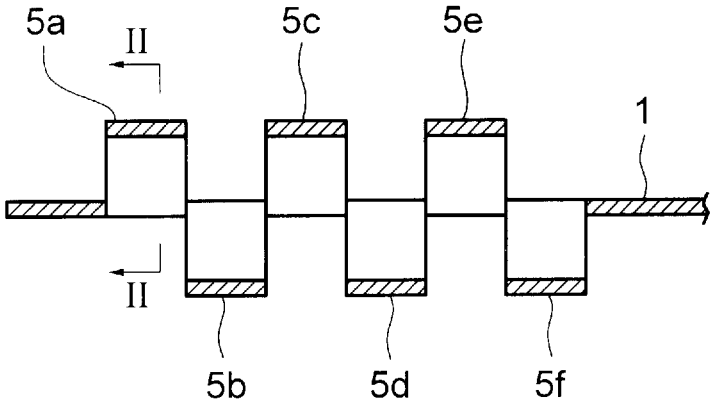
FIG. 5 (PRIOR ART)
FIG. 5 is a sectional view taken along line A—A in FIG. 4.

There follows a detailed description of preferred embodiments of a heat exchanger of an air conditioner according to the present invention and with reference to the accompanying drawings.

Throughout the drawings, like reference numerals and symbols are used for designation of like or equivalent parts or portions as in the prior art.

Reference numeral 20 (and box B) represents an array of slit-forming grilles that form slits extending transversely of the direction of the air current flow. Each array 20 is arranged between two vertically spaced heat transfer pipes 2A, 2B and is disposed generally radially with respect to center axes of respective heat transfer pipes 2, so that the air current flowing along each surface of the fin 1 is disturbed (i.e., becomes turbulent) and mixed. That reduces the cavitation zone being generated at a rear side of the heat transfer pipes 2 and increases a heat transfer efficiency for enhanced heat transmission performance.

Figure 6:
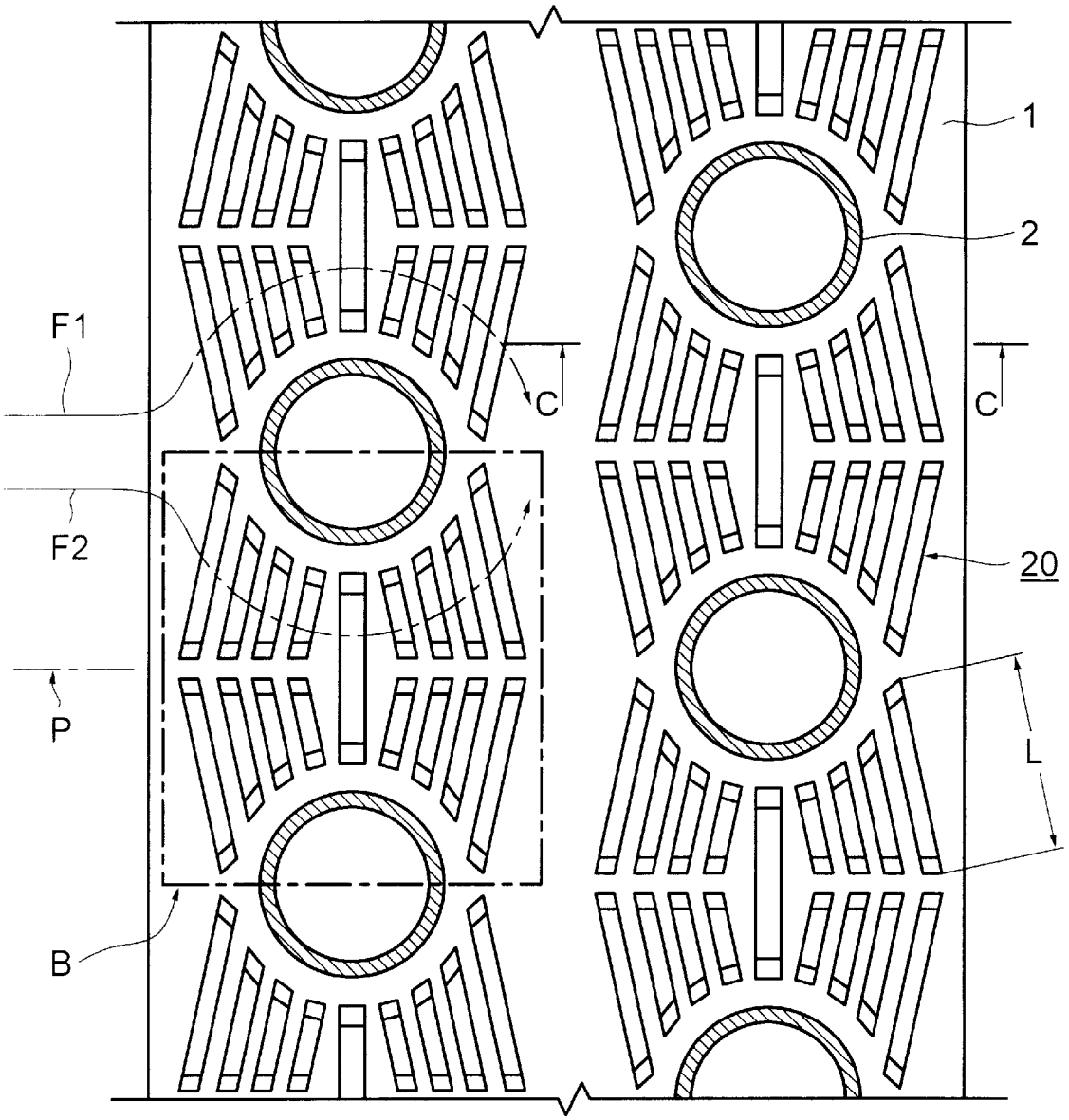
FIG. 6 is a side view for illustrating a flat fin of a heat exchanger according to the present invention.
Figure 7:
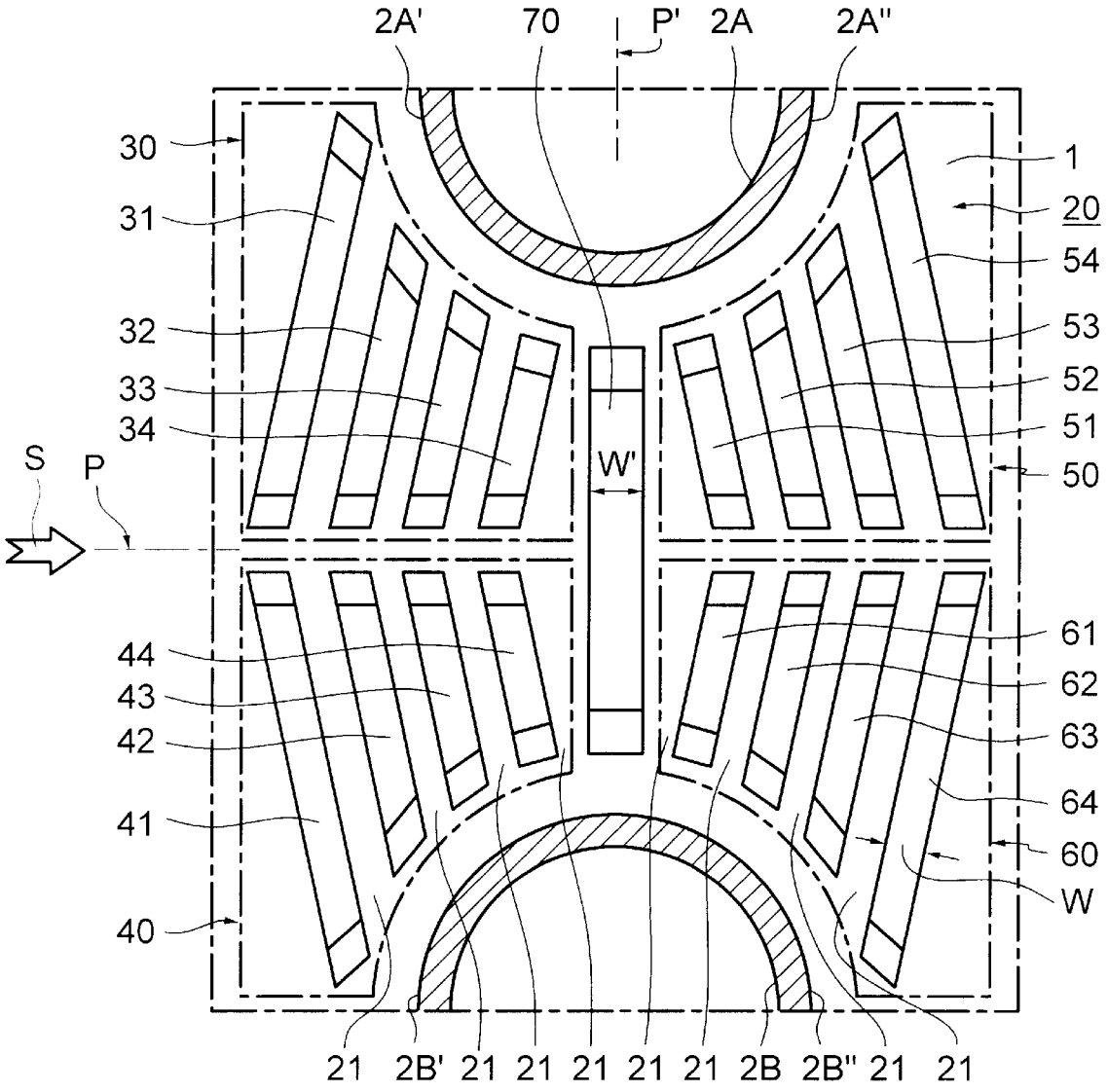
FIG. 7 is an enlarged view of B part in FIG. 6.
Figure 8:
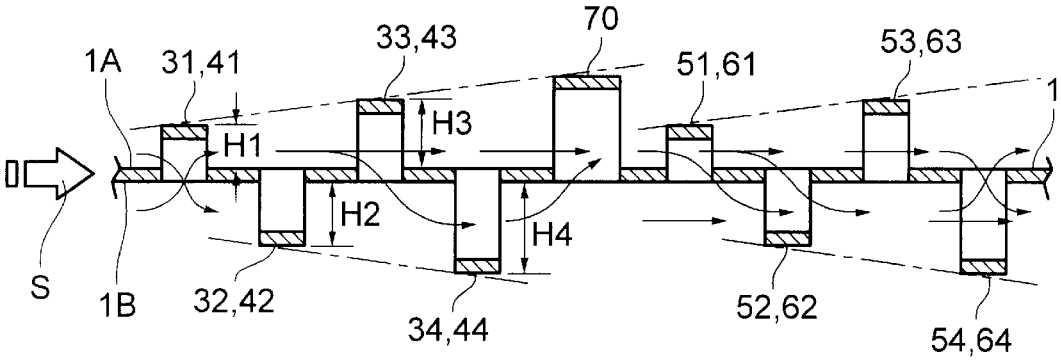
FIG. 8 is a sectional view taken along line C—C in FIG. 7.

In other words, the array 20 includes, as illustrated in FIGS. 6, 7 and 8, first, second, third, and fourth groups of slit-forming grilles 30, 40, 50, 60. The grilles of each of the groups 30–60 are spaced apart by solid portions 21 of the fin and are inclined obliquely with respect to a center plane P extending midway between the two pipes 2, as viewed in FIG. 6.

The first group 30 is comprised of four grilles 31–34. The grilles 31 and 33 project from a first side 1A of the fin, and the grilles 32 and 34 project from a second side 1B of the fin. The first group 30 is located along an upstream half of a lower portion of the pipe 2A. That is, the grille 31 is disposed adjacent a front side 2A' of a respective pipe 2A, and the grille 34 is disposed at a location about midway between front and rear sides 2A', 2A" of the pipe 2A. The grilles 31–34 are of progressively shorter length L from the grille 31 to the grille 34, as viewed in FIG. 6. The first group of grilles 30 causes the air current to be disturbed when it traverses the upstream half of the lower portion of the pipe 2A.

The second group 40 is comprised of four grilles 41–44. The grilles 41 and 44 project from the first side 1A of the fin, and the grilles 42 and 44 project from the second side 1B of the fin. The second group of grilles 40 is located along an upstream half of an upper portion of the pipe 2B. That is, the grille 41 is disposed adjacent a front side 2B' of a respective pipe 2B, and the grille 44 is disposed at a location about midway between front and rear sides 2B', 2B" of the pipe of the pipe 2B. The grilles 41–44 are of progressively shorter length from the grille 41 to the grille 44. The inclination of the grilles 41–44 is such that they converge in a forward (i.e., upstream) direction with respective ones of the grilles 31–34. The second group 40 causes the air current to be disturbed when it traverses the upstream half of the upper portion of the pipe 2B.

The third group 50 is comprised of four grilles 51–54. Those grilles are inclined so as to be substantially parallel with the grilles 41–44 of the second group. The grilles 51 and 53 project from the first side 1A of the fin, and the grilles 52, 54 project from the second side 1B of the fin. The third group 50 is located along a downstream half of the lower portion of the pipe 2A. That is, the grille 51 is disposed at a location about midway between the front and rear sides 2A', 2A" of the pipe 2A, and the grille 54 is disposed adjacent the rear side 2A" of the pipe 2A. The grilles 51–54 are of progressively longer length from the grille 51 to the grille 54. The third group of grilles 50 causes the air current to be disturbed when it traverses the downstream half of the lower portion of the pipe 2A.

The fourth group 60 is comprised of four grilles 61–64. Those grilles are inclined relative to the plane P so as to extend parallel to the first group of grilles 31–34. The grilles 61 and 63 project from the first side 1A of the fin, and the grilles 62, 64 project from the second side 1B of the fin. The fourth group of grilles 60 is located along a downstream half of an upper portion of the pipe 2B. That is, grille 61 is disposed at a location about midway between the front and rear sides 2B', 2B" of the pipe 2B, and the grille 64 is located adjacent the rear side 2B" of the pipe 2B. The grilles 61–64 are of progressively greater length from the grille 61 to the grille 64. The fourth group of grilles 60 causes the air current to be disturbed when it passes the downstream half of the upper portion of the pipe 2B.

An intermediate grille 70 projects from the first side 1A of the fin 1 and extends perpendicular to the plane P along a plane P' containing the axes of the pipes 2A, 2B. The intermediate grille 70 disturbs the air current traveling between the first and third groups 30, 50, and also disturbs the air flow traveling between the second and fourth groups 40, 60.

As noted earlier, solid portions 21 of the fin are located on both sides of each of the grilles of the four groups of grilles, as well as the intermediate grille.

The widths W of the grilles of the first, second, third, and fourth groups are identical and narrower than the width W' of the intermediate grille 70 (see FIG. 7).

Each of the grilles has a height dimension defined by the distance by which the grille projects from a respective side of the fin. As can be seen in FIG. 8, the grilles of each of the four groups are of progressively greater height H1–H4 in the direction of air flow S. That is, the heights increase from left to right in FIG. 8. Furthermore, the intermediate grille 70 has a height greater than that of any of the grilles.

In other words, the heights of the first grilles (31, 41, 51, 61) are shorter than the heights of the second grilles (32, 42, 52, 62). Those second grilles are of shorter height than the third grilles (33, 43, 53, 63), and the third grilles are of shorter height than the fourth grilles (34, 44, 54, 64). All of the grilles of groups 30–60 are lower in height than the intermediate grille 70, as illustrated in FIG. 8.

It will be appreciated that as air flows in the direction S, a portion of the air flow traveling along the first side 1A of the fin will be transferred to the second side 1B of the fin through the grilles 31, 41, 33, 43, 70, 51, 61, 53, 63. Also, a portion of the air flow traveling along the second side 1B of the fin will be transferred to the first side 1A through the grilles 32, 42, 34, 44, 52, 62, 54, 64. Now, the operation of the heat exchanger disclosed in connection with FIGS. 6–8 will be explained. When air flows in the direction S it becomes turbulent while passing through the first, second, third, and fourth groups of grilles and the intermediate grille 70. The air current is simultaneously divided into respective air flows F1, F2 traveling around each of the pipes 2, as shown in FIG. 6. Those air flows are rejoined adjacent the downstream or rear side of the pipe. This produces a mixing action.

Because the air becomes turbulent, the cavitation zone formed at the rear side of each pipe 2 is reduced, and the heat transfer efficiency is increased at that rear side.

The inclinations of the first and second grilles 31, 33, 41, 43, 51, 53, 61 63 is such that part of the air current flowing along the first surface 1A is transferred to the second surface 1B. Furthermore, the inclinations of the third and fourth grilles 32, 34, 42, 44, 52, 54, 62, 64 is such that part of the air current flowing along the second surface is transferred to the first surface. Now, the operation of the heat exchanger of an air conditioner according to the embodiment of the present invention thus constructed will be described.

When the air current flows between the fins 1 in the direction of an arrow (S) illustrated in FIG. 8, it becomes turbulent while it passes through the first, second, third, fourth, fifth groups (30), (40, 50, 60, 70) of the array 20.

The flowing air current is simultaneously divided thereby into two flows F1, F2 which thereafter join together for creating a mixed air current.

By becoming turbulent, the air current effectively reduces the cavitation zone at the rear side of each heat transfer pipe 2 and increases the heat transfer efficiency at that rear side.

Also, part of each flow travels along the first surface 1A, and another part travels along the second surface 1B. Portions of those flows are transferred back and forth between the first and second sides 1A, 1B of the fin via the slits formed by the grilles, as shown by the arrows in FIGS. 8 and 9.

The arrangement of the grilles whereby they project from opposite sides of the fin in alternating relationship and at progressively varying heights increases the temperature boundary layer effect and minimizes pressure drops of the third, thereby increasing heat exchange efficiency.

Also, the arrangement of the grilles whereby they extend generally radially relative to the pipes results in fluid flow being guided to locations behind the pipes to reduce the sizes of cavitation zones.

The grilles also serve to increase heat transfer efficiency at the rear of the heat transfer pipes 2, and to expedite a flow of the heat toward the heat transfer pipes 2.

Although the above-mentioned description has described an embodiment of a heat exchanger of an air conditioner where the grilles of the third and fourth groups (50), (60) are gradually more increased in height, the present invention is not limited by the above-mentioned embodiment.

Figure 9:
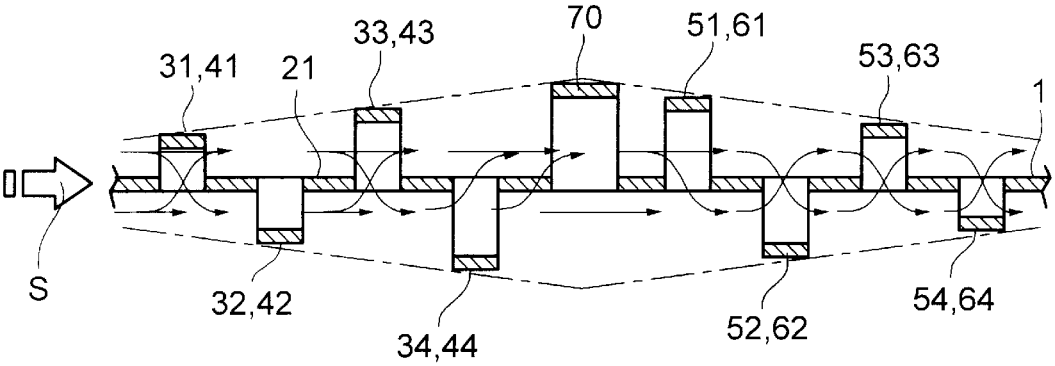
FIG. 9 is a sectional view for illustrating grille height difference according to another embodiment of the present invention.

By way of example, as another embodiment shown in FIG. 9, the grilles of the third and fourth groups (50), (60) become gradually decreased in height in the direction of fluid flow.

In other words, the heights of grilles 31 and 41 are equal to those of grilles 54, 64 (see FIG. 9). The heights of grilles 32, 42 are the same as those of grilles 53, 63. The heights of grilles 33, 43 are the same as those of grilles 52, 62. The heights of grilles 34, 44 are the same as those of grilles 51, 61.

It is intended that this and other such changes and modifications shall fall within the spirit and scope of the invention defined in the appended claims.

As is apparent from the foregoing, there is an advantage resulting from group of grille parts radially formed around the periphery of heat transfer pipes opened toward oncoming air current and protruding from inner and external surfaces of the flat fins at predetermined angles, and at different heights, in that those grille parts serve to strongly mix the moving air current and make the air current turbulent to effectively decrease the cavitation zones generating at the backs of the heat transfer pipes and to further increase heat transfer efficiency.

There is another advantage in that the rate of heat transfer at each of the heat transfer pipes is increased.

What is claimed is:

1. A heat exchanger adapted for use in an air conditioner, the heat exchanger including a plurality of parallel planar fins spaced apart to conduct an air flow between each pair of adjacent fins, and heat transfer pipes extending through the fins perpendicular thereto for conducting a heat transfer fluid, the fins comprising:

first, second, third, and fourth groups of slit-forming grilles disposed between each vertically spaced pair of pipes, the first and third groups disposed below a first pipe of the pair, and the second and fourth groups disposed above a second pipe of the pair, the third group disposed behind the first group with reference to a direction of air flow, and the fourth group disposed behind the second group; and an intermediate slit-forming grille extending transversely to the air flow direction and located behind the first and second groups and in front of the third and fourth groups;

each of the grilles extending transversely relative to the air flow direction;

the grilles of each of the first and second groups projecting from the fin by respective heights which become progressively greater in the direction of air flow;

the grilles of each of the third and fourth groups projecting from the fin by respective heights which become progressively greater in the direction of air flow;

wherein a height of the intermediate grille is greater than the heights of all other grilles.

2. The heat exchanger according to claim 1 wherein each of the groups includes some grilles extending from a first side of the fin, and some grilles extending from a second side of the fin in alternating relationship to the grilles of the first side with reference to the fluid flow direction.

3. The heat exchanger according to claim 2 wherein each of the groups includes two grilles extending from the first side and two grilles extending from the second side.

4. The heat exchanger according to claim 3 wherein each grille is spaced from adjacent grilles by a solid portion of the fin.

5. The heat exchanger according to claim 1 wherein the grilles of the first and third groups extend generally radially with respect to the first pipe, and the grilles of the second and fourth groups extend generally radially with respect to the second pipe.

6. The heat exchanger according to claim 1 wherein each of the grilles of the groups extends obliquely relative to a center plane extending midway between the first and second pipes in the fluid flow direction, the intermediate grille extending perpendicular to the center plane and bisected thereby.

7. The heat exchanger according to claim 1 wherein the grilles of the groups have equal widths extending in the fluid flow direction, and the intermediate grille has a larger width than the grilles of the groups.

8. A heat exchanger adapted for use in an air conditioner, the heat exchanger including a plurality of parallel planar fins spaced apart to conduct an air flow between each pair of adjacent fins, and heat transfer pipes extending through the fins perpendicular thereto for conducting a heat transfer fluid, the fins comprising:

first, second, third, and fourth groups of slit-forming grilles disposed between each vertically spaced pair of pipes, the first and third groups disposed below a first pipe of the pair, and the second and fourth groups disposed above a second pipe of the pair, the third group disposed behind the first group with reference to a direction of air flow, and the fourth group disposed behind the second group; and an intermediate slit-forming grille extending transversely to the air flow direction and located behind the first and second groups and in front of the third and fourth groups;

each of the grilles extending transversely relative to the air flow direction;

the grilles of each of the first and second groups projecting from the fin by respective heights which become progressively greater in the direction of air flow;

the grilles of each of the third and fourth groups projecting from the fin by respective heights which become progressively shorter in the direction of air flow;

wherein a height of the intermediate grille is greater than the heights of all other grilles.

9. The heat exchanger according to claim 8 wherein each of the groups includes some grilles extending from a first side of the fin, and some grilles extending from a second side of the fin in alternating relationship to the grilles of the first side with reference to the fluid flow direction.

10. The heat exchanger according to claim 9 wherein each of the groups includes two grilles extending from the first side and two grilles extending from the second side.

11. The heat exchanger according to claim 10 wherein each grille is spaced from adjacent grilles by a solid portion of the fin.

12. The heat exchanger according to claim 8 wherein the grilles of the first and third groups extend generally radially with respect to the first pipe, and the grilles of the second and fourth groups extend generally radially with respect to the second pipe.

13. The heat exchanger according to claim 8 wherein each of the grilles of the groups extends obliquely relative to a center plane extending midway between the first and second pipes in the fluid flow direction, the intermediate grille extending perpendicular to the center plane and bisected thereby.

14. The heat exchanger according to claim 8 wherein the grilles of the groups have equal widths extending in the fluid flow direction, and the intermediate grille has a larger width than the grilles of the groups.

* * * * *